United States Patent [19]

Gillotti

[11] Patent Number: 4,469,084

[45] Date of Patent: Sep. 4, 1984

[54] DEVICE FOR COLLECTING EMISSIONS FROM KEROSENE HEATERS

[75] Inventor: Nathan J. Gillotti, Danbury, Conn.

[73] Assignee: Spinair Corp., Danbury, Conn.

[21] Appl. No.: 499,116

[22] Filed: May 27, 1983

[51] Int. Cl.[3] ..... F24C 5/04

[52] U.S. Cl. ..... 126/96; 126/248; 126/299 F; 126/313; 55/387; 55/473; 55/267

[58] Field of Search ..... 126/93, 96, 97, 248, 126/83, 299 R, 299 F, 113, 134, 313; 431/309, 310; 55/332, 387, 430, 473, 267, 385 R; 110/216, 217

[56] References Cited

U.S. PATENT DOCUMENTS

| | | | |
|---|---|---|---|
| 195,794 | 10/1877 | Case | 126/4 |
| 605,234 | 6/1898 | Sherk | 126/299 F |
| 764,843 | 7/1904 | Hallett | 126/248 |
| 954,153 | 4/1910 | Wikstrom | 126/96 |
| 1,226,964 | 5/1917 | Fischer | 126/248 |
| 1,276,886 | 8/1918 | Eberhardt | 126/96 |
| 1,304,728 | 5/1919 | Baron | 126/248 |
| 3,863,620 | 2/1975 | Warner | 126/248 |
| 4,250,609 | 2/1981 | Beaudoin | 126/307 R |
| 4,286,975 | 9/1981 | Whiteley | 110/216 X |

FOREIGN PATENT DOCUMENTS

| | | | |
|---|---|---|---|
| 0046137 | 2/1982 | European Pat. Off. | 126/299 F |
| 0068520 | 5/1980 | Japan | 126/96 |
| 0142407 | 9/1982 | Japan | 431/310 |

*Primary Examiner*—Samuel Scott
*Assistant Examiner*—Margaret A. Focarino
*Attorney, Agent, or Firm*—Karl W. Flocks; Sheridan Neimark

[57] ABSTRACT

An apparatus for both improving the heat distribution throughout a room from a portable kerosene heater and for collecting undesirable emissions resulting from the burning of the kerosene, includes a base adapted to be mounted on the top of the heater, the base supporting a vertically extending shaft on which is mounted a heat-driven fan formed of either paper or metal, and a disposable disk mounted a spaced distance above the fan on the same shaft, the disk serving as a collector for the undesirable emissions. When the device is placed on an operating kerosene heater, the rising hot air and gases from the heater cause the fan to rotate, which in turn causes emissions from the burning fuel to move upwardly in a more or less cylindrical path. As the products of combustion move upwardly, certain emissions therein such as soot, oily vapors, etc. deposit or condense onto the surface of the spinner and disposable disk.

21 Claims, 7 Drawing Figures

DEVICE FOR COLLECTING EMISSIONS FROM KEROSENE HEATERS

FIELD OF THE INVENTION

The present invention relates to the improvement of the environment and, more particularly, to collecting possibly harmful emissions or pollutants from kerosene heaters.

BACKGROUND OF THE INVENTION

In these days of rising fuel costs, the need for efficient space heating has become more acute. Central heating is normally relatively wasteful of fuel, and, accordingly, space heating has become increasingly desirable from the economic viewpoint. Among the most economical space heaters are kerosene heaters, and much progress has been made in the design of kerosene heaters over the past decade, particularly insofar as safety of such heaters is concerned.

Nevertheless, a number of problems continue to exist with respect to kerosene space heaters. Primary among these problems is the fact that these kerosene space heaters, because they burn a fuel in a relatively closed environment, inevitably emit potentially harmful products of combustion, including a certain degree of soot and oily vapors, as well as carbon dioxide which is the desired product of combustion. As kerosene space heaters have no chimney, the products of combustion are deposited in the space, i.e., the room, being heated when they are taken into the lungs. It is therefore desirable to eliminate or at least minimize to the greatest extend possible all emissions other than carbon dioxide. While modern kerosene heaters are extremely efficient, even the best do continue to emit some quantities of undesirable oily vapors and soot into the hatitable space environment.

The 1919 Baron U.S. Pat. No. 1,304,728 discloses a heat distributor for location above a gas burner. The distributor is made in the form of a propeller or fan and comprises a circular body having a conical cap which rests on the tip of a rod, the body being cut with a number of L-shaped incisions so as to produce blades or flukes. Heated air rising from the gas burners escapes through the blades thereby causing the propeller or fan to rotate and thereby throw the heat to remote parts of the room.

The 1917 Fischer U.S. Pat. No. 1,226,964 discloses a gas heater having a rotatable fan thereabove. Similar to the aforementioned Baron patent, the currents of heated air from the flame cause the fan to rotate thereby throwing the heated air outwardly and improving heated air distribution.

The Warner U.S. Pat. No. 3,863,620 discloses a device adapted to be set over a heat-supplying source such as a cleanly burning burner, a stove top, or an electrically heated unit. The device includes a hood having an open side so constructed and arranged that a rising, breatheable air current, produced by convection, will be deflected and redirected substantially horizontally to occupied portions of the occupied area. A series of disk-shaped heat absorbers are provided within the hood.

The 1904 Hallett U.S. Pat. No. 764,843 discloses a heater for attachment to a kerosene burner, including a series of disk-shaped plates which fit above and are heated by the rising vapors. The patent indicates that these plates become hot, and that the disclosed structure "also prevents the smoking of the ceiling" (lines 79–80).

The 1895 Willis U.S. Pat. No. 538,718 discloses a smoke arrester for "arresting, removing and recovering carbon from smoke". The device is adapted for placement in a chimney or flue and it comprises a double cone-shaped screen beneath and above which are provided fans "operated by the draft within the flue or chimney".

The Beaudoin U.S. Pat. No. 4,250,609 shows a disposable chimney liner in bag form which is inflated within a chimney to provide a liner so that grease which would deposit in the chimney will instead deposit on the liner.

The Benoit U.S. Pat. No. 2,141,782 discloses an inverted dish-shaped perforated deflector which assists in removing particulate material from a gaseous stream.

No device is known which is suitable for use with a portable kerosene heater, to assist in the elimination of emissions from the heater, and yet which device is simple, inexpensive and includes inexpensive disposable elements.

SUMMARY OF THE INVENTION

It is, accordingly, an object of the invention to overcome deficiencies in the prior art, such as indicated above.

It is another object to improve the environment, more especially to eliminate possibly harmful emissions or pollutants from space heaters which burn combustible fuels.

It is still another object to provide a device for use in conjunction with a fuel burning space heater, which device assists in distributing the heat from the space heater and which device furthermore removes harmful emissions given off by the fuel-burning space heater.

It is yet another object to provide a device such as that indicated immediately above, which is inexpensive, simple and effective, and which may utilize inexpensive disposable elements which absorb the possibly harmful emissions and which can then be thrown away.

The above and other objects of the invention, which other objects will be more apparent from the following description, are achieved according to the invention by providing a device which improves the heat distribution and causes to be collected certain emissions which emanate from the combustion of fuels in heaters operated with partial or no ventilation such as, but not limited to, kerosene heaters. Such a device includes a spinner or disk with integral vanes mounted on an axis either directly on the heater or on a base which rests on the heater, the spinner or disks being so situated that the convection current of rising hot air provided by the heater causes the spinner to rotate freely without external force or energy input.

The device desirably has a second spinner or disk, with or without vanes, mounted above the first spinner on an extension of the axis which holds the first spinner. Moreover, different configurations, can be similarly mounted above the second spinner or disk. The design and shape of the spinners, disks or other configurations are such that certain emissions of the combustion process, such as carbon or soot, oily vapors and combustion gases, are deposited or condensed onto the surface of the spinners, disks or the like.

Such spinners, disks or similar configurations are formed of materials selected so as to be conducive to optimizing the entrapment or attraction of particulates or gases in varying amounts. Ideally one or more of these elements is formed of disposable paper or pulp material, desirably incorporating flame-retardant chemicals, preferably chemicals capable of reacting with known combustion gases such as nitrogen oxide and sulphur dioxide. The design and selection of materials used in the spinners or disks lend themselves to being disposed of after a period of use, due to low cost and a desire to have cleaner absorptive surfaces for proper efficiency.

The base mount of the spinner is utilizable in the shape of a bowl or shallow pan as a container to hold water to improve humidity conditions or to provide means of introducing deodorizing materials or fragrances into the space environment in which the heater is located. The evaporation of water reduces the heat content of the convected gases allowing increased efficiency in condensation of soot and oily residues on the surfaces of the lower temperature disks or spinners, and increasing the efficiency of collecting combustion products such as sulphur and nitrogen oxides and carbon monoxide onto the reactive surfaces of the disks or spinners.

For a better understanding of the invention, as well as the above and other objects and the nature and advantages of the instant invention, several possible embodiments thereof will now be described with reference to the attached drawing, it being understood that these embodiments are intended as merely exemplary and in no way limitative.

DETAILED DESCRIPTION OF EMBODIMENTS

Figure 1:
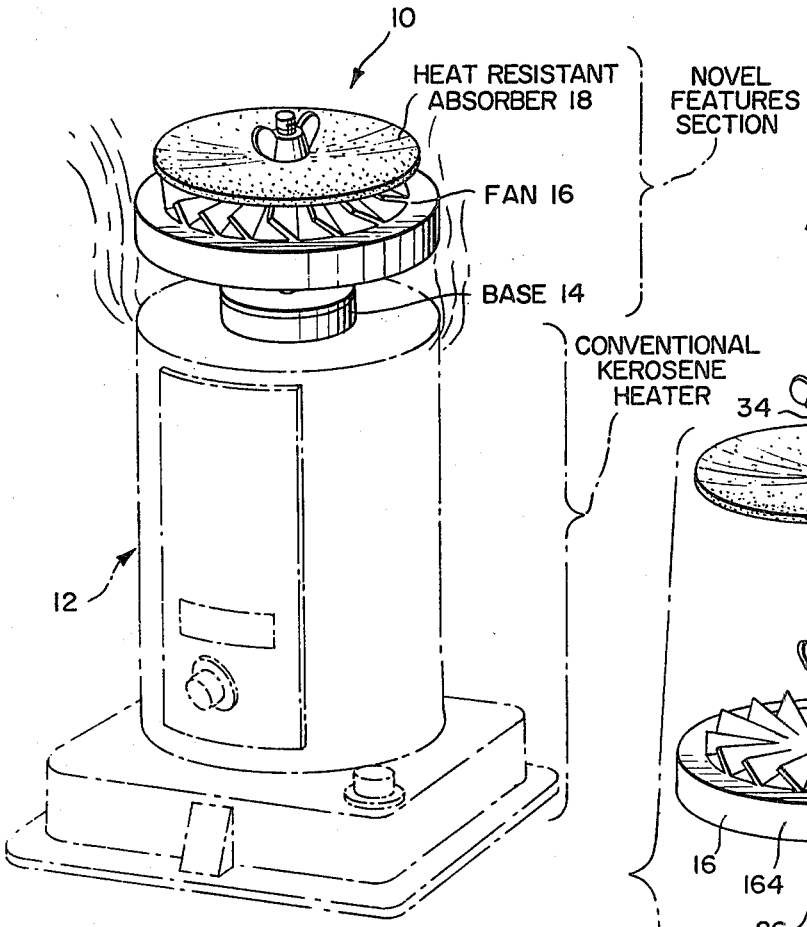
FIG. 1 is a schematic perspective illustration of an embodiment of the instant invention.

FIG. 1 shows a device 10 according to the invention placed on top of a conventional kerosene space heater 12. A simple form of the device 10 comprises a base 14 above which is rotatably mounted a fan or spinner 16, and thereabove a rotatable heat-resistant pollutant absorber 18, preferably formed of paper or molded pulp and which is intended to be discarded after a period of use.

Figure 2:
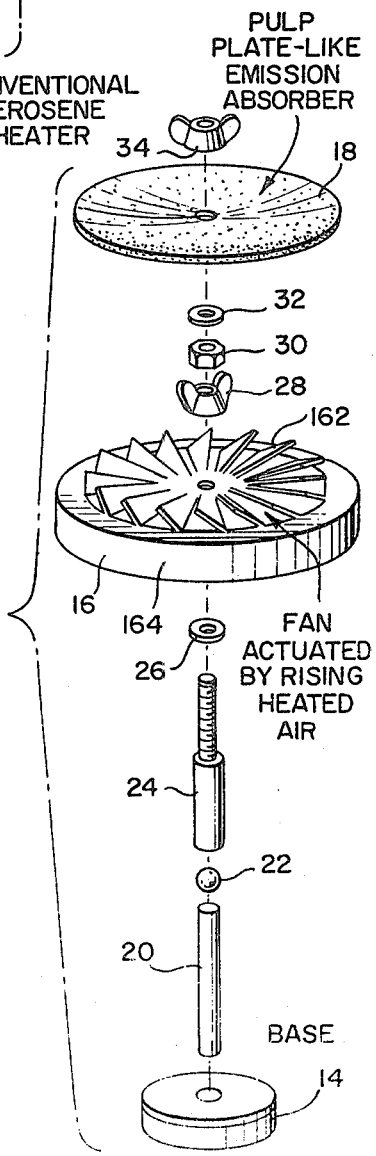
FIG. 2 is a broken apart perspective view of the device of FIG. 1.

With reference to FIG. 2, it is seen that the base 14 may merely constitute a weighted element which receives in its upper surface a stationary support shaft 20 which holds on its upper surface, which may be dished, a ball bearing 22. A main shaft 24 having a hollow bottom portion fits over the ball bearing 22 and over the support shaft 20, and is thereby freely rotatable about its axis which is coincident with the axis of the support shaft 20. Mounted directly on and for rotation with the main shaft 24 is a suitable washer 26 and the fan or spinner 16. To hold such spinner 16 in place, a suitable wing nut 28 or the like is provided. On top of the wing nut there may then be screwed onto the upper portion of the main shaft a hex nut 30 and another washer 32. Over the upper washer 32 is provided the heat-resistant absorber 18 in the form of a disk or plate, and this in turn is held in place by a second wing nut 34.

Figure 6:
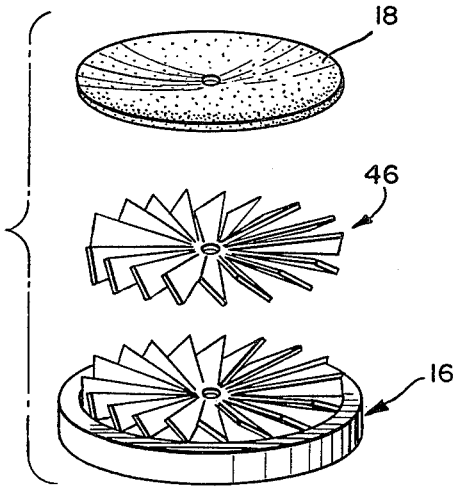
FIG. 6 is an expanded view of another embodiment according to the present invention.

It will be understood that more than two elements 16 and 18 may be provided. Thus, the main shaft 24 can be made longer, particularly the upper portion thereof, so as to provide more than two elements, such as the three elements in FIG. 6, or even more than three elements. Regardless of the embodiment, it is desirable that the vertically stacked elements be spaced from one another, e.g. from one to six inches apart. Accordingly, returning to FIG. 2, it will be understood that the hex nut 30 will be spaced on the upper threaded portion of the main shaft 24 a suitable distance above the wing nut 28 so as to provide proper spacing between the elements 16 and 18.

Figure 5:
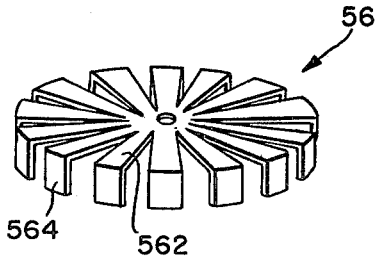

The elements themselves may take various forms. In FIGS. 1 and 2, the fan or spinner 16 is illustrated as a permanent, metallic element having a plurality of blades 162 surrounded by an annular, downwardly depending flange 164. Instead of an annular flange 164, each blade 562 may have a flange 564 depending downwardly from its outer end as in the fan of FIG. 5. In any event, the inverted dish-shaped distribution of the spinner or fan 16 has a tendency to catch the upwardly rising air and the combustion gases which effects rotation thereof along with the main shaft 24 and the one or more elements stacked above the spinner 16 and also attached to the main shaft 24.

Figure 3:
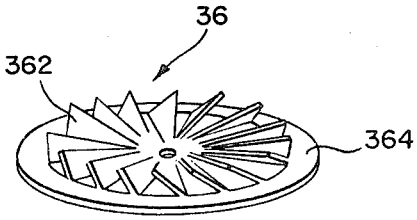
FIGS. 3, 4 and 5 are perspective illustrations of other forms of spinners for use in the device of the present invention.
Figure 4:
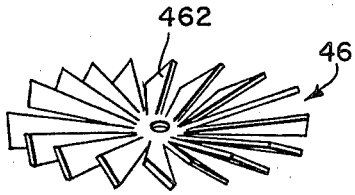

The spinner or fan 16 may take other shapes and forms such as shown in FIGS. 3 and 4. The spinner 36 of FIG. 3 is desirably formed of paper or molded pulp and has a plurality of blades 362 and an annular reinforcing portion 364. The spinner 46 of FIG. 4, also desirably formed of paperboard or molded pulp, is otherwise similar having a plurality of blades 462, but no annular reinforcing portion.

Returning again to FIG. 6, it will be seen that the various elements may be placed together in various combinations, so long as at least the bottommost element is a spinner having blades, such as the spinner 16, or alternatively a spinner 36, 46 or 56.

It must also be understood that both (or all) the elements may be spinners and that a plain disk such as 18 need not be used at all. In other words, with reference to FIG. 2, it will be understood that a spinner 36 as shown in FIG. 3 or a spinner 46 as shown in FIG. 4, can be substituted for the plate 18. If a disk 18 is used, again preferably formed of paperboard or molded pulp, it may be flat as shown in FIG. 2 or it may be dish-shaped as shown in FIG. 1. Indeed, in one experimental model of the present device, a paper plate was used as the disk 18; and in another experimental model a paper plate cut to provide a configuration similar to the spinner 46 of FIG. 4 was used as the upper element 18.

It is desirable according to the invention, although not essential, that when paper elements are used, such as for the disk 18 and spinners 36 and 46, regardless of their location or position, they be impregnated with or incorporate a suitable fire-retardant chemical. Such fire-retardant chemicals, which may be used individually or in combination, may be incorporated during the formation of the paperboard or molded pulp or it may be impregnanted after formation. While many fire-retardant chemicals are known and commonly used, it is preferred to use household fire-retardant chemicals such as washing soda, borax, boric acid, sodium bicarbonate, calcium acid phosphate or di-sodium phosphate, the latter two of which are in baking soda, or possibly di-ammonium phosphate.

Alkaline fire-retardant chemicals are preferred, as these are reactive with nitrogen oxide and sulphur dioxide emissions, and therefore will help capture these pollutants. Among such alkaline, fire-retardant chemicals are preferred soda ash, i.e. sodium carbonate, di-sodium or tri-sodium phosphate, di-ammonium phosphate, or mixtures thereof. As indicated above, these may be impregnated into the already formed paper, but they are preferably added during the manufacture of the paper at the wet end, and are preferably present in an amount of 1–10% by weight based on the cellulose. Calcium carbonate filled paperboard or molded pulp can also be suitably used.

Figure 7:
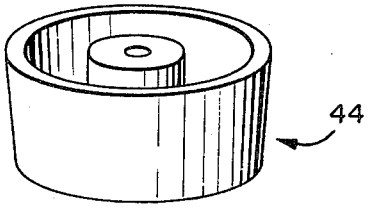
FIG. 7 shows an alternate form of a base for use in the device according to the invention.

In place of the solid base 14, there may instead be used a bowl-shaped base 44 as shown in FIG. 7. The use of such a base provides means to hold water to improve humidity conditions. In addition, it is thereby possible to add deodorizing materials or fragrances to the water. The evaporation of water reduces the heat content of the convected gases allowing increased efficiency in condensation of the soot and oily residues on the spinners and/disks.

The operation of the device is very simple. Heat rising from the kerosene heater 12 causes the spinner 16 to rotate. As soon as this occurs, an upward draft is created which draws the majority of air and gas leaving the kerosene heater upwardly in a cylindrical column so that it passes both through and around the fan or spinner 16. As the heated air and combustion gases move upwardly in a more or less cylindrical path, the pollutants in the combustion gases, including nitrogen and sulphur oxides, soot and oily emissions, contact and deposit on the surfaces of the spinner and disk absorbers. Where the spinners and disks are of paperboard or molded pulp, they are more or less porous and thus tend to absorb some of the emissions into the interior, particularly when impregnated with a fire-retardant chemical which is capable of reacting with nitrogen and sulphur oxides; and when such elements become dirty they are merely discarded and replaced with new disposable elements. Where the spinner is a metallic element, it will need to be periodically cleaned.

While no quantative tests have been conducted, on a qualitative level the heat resistant absorber elements 18, 46 have been found to become dirty through the deposit thereon of oil emissions and soot after several hours of operation, with the base 14 resting on the top of a conventional kerosene heater 12 as shown in FIG. 1. Also on a qualitative level, the odor level in the room has been found to be noticeably reduced when a device 10 according to the invention is used as described above and illustrated in FIG. 1. A secondary advantage, besides the primary advantage of reducing emitted pollutants, is the improved distribution of heat throughout the space in which the heater is located.

While the absorber elements described above are indicated to be preferably formed of paperboard or molded pulp, desirably containing fire-retardant and emission-absorbent chemicals, it will be understood that other materials can also be used. For example, such absorber elements may be formed of woven or non-woven fiberglass, or fiberglass may be an additive. The fiberglass may be of short fibrous materials, or long fibrous materials, and it may be mixed with other fibers and/or binders and/or other additives. Among such other fibers may be mentioned synthetic fibers, metallic fibers, ceramic fibers and graphite fibers which may replace, in whole or in part, the glass fibers. These structures may be sintered or partially fused.

The absorber elements may be made of other materials as well, including porous open structures such as foam plastics, for example polyurethane foam.

Regardless of the construction of the absorber elements, they are desirably of a porous, open construction, and they desirably have functional additives incorporated therein, which functional additives are capable of reacting with or sorbing the undesirable emissions, such as carbon monoxide and oxides of sulphur and nitrogen. For example, absorbant and/or adsorbant fillers such as carbon particles may be incorporated into the body of the adsorbant element, or active or catalytic metal particles may be similarly incorporated. It is also possible to incorporate chemical indicators which may change color or otherwise indicate when certain emissions have been captured by the absorbant elements. Such reactive materials and/or chemical indicators can be coated on or impregnated in the porous absorbant element.

The foregoing description of specific embodiments will so reveal the general nature of the invention that others can, by applying current knowledge, readily modify such specific embodiments and/or adapt such specific embodiments for various applications, without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A device for collecting emissions from a kerosene heater or the like, and for improving the distribution of heated air from such a heater, comprising base means for locating and supporting said device above the heater, and including a vertical shaft;

spinner means mounted on said shaft for rotation about the axis of said shaft relative to said base means, said spinner means being capable of being rotatably driven about the axis of said shaft by hot air rising from the heater, for causing hot air and combustion gases from the heater to move upwardly in a generally cylindrical column, said spinner means comprising a plurality of fan blades; and at least one heat-resistant, rotatable, pollutant absorber means mounted on said shaft and spaced above said spinner means for rotation therewith, for collecting polluting emissions from the gases of combustion of the heater.

2. A device according to claim 1, wherein said spinner means comprises a metallic fan element.

3. A device according to claim 1, wherein said spinner means has at least one flange extending downwardly at its periphery.

4. A device according to claim 1, wherein said spinner means is formed of a heat-resistant, absorbant material.

5. A device according to claim 4, wherein said heat-resistant, absorbant material comprises paperboard or molded wood fiber.

6. A device according to claim 5, wherein said paperboard or molded wood fiber comprises, mixed therewith, at least one fire-retardant chemical.

7. A device according to claim 6, wherein said fire-retardant chemical is present in an amount of 1–10% by weight based on the weight of paper or wood fibers.

8. A device according to claim 6, wherein said fire-retardant chemical is calcium carbonate; boric acid; borax; mixtures of borax and boric acid; sodium carbonate; di-sodium or tri-sodium phosphate; diammonium phosphate; or mixtures of two or more of sodium carbonate, di-sodium phosphate, tri-sodium phosphate and diammonium phosphate.

9. A device according to claim 1, wherein said heat-resistant absorber comprises paperboard or molded wood fiber.

10. A device according to claim 9, comprising plural heat-resistant absorbers mounted on said shaft and spaced apart from one another.

11. A device according to claim 9, wherein said heat-resistant absorber is in the form of a disk.

12. A device according to claim 9, wherein said heat-resistant absorber is in the form of a spinner element having a plurality of blades extending radially outwardly from the center thereof.

13. A device according to claim 12, wherein said paperboard or molded wood fiber comprises, mixed therewith, at least one fire-retardant chemical.

14. A device according to claim 13, wherein said fire-retardant chemical is present in an amount of 1–10% by weight based on the weight of paper or wood fibers.

15. A device according to claim 12, wherein said fire-retardant chemical is calcium carbonate; boric acid; borax; mixtures of borax and boric acid; sodium carbonate; di-sodium or tri-sodium phosphate; diammonium phosphate; or mixtures of two or more of sodium carbonate; di-sodium phosphate; tri-sodium phosphate and diammonium phosphate.

16. A device according to claim 1, wherein said base means is adapted to be removably placed on the top of a kerosene heater.

17. A device according to claim 16, wherein said base means comprises a dish-shaped element adapted to contain water.

18. A device according to claim 1 wherein the heat resistant-absorbent material comprises a mixture of paper or wood fibers together with mineral fibers or particles.

19. A device according to claim 18 wherein said mineral fibers or particles are selected from the group consisting of glass fibers, metallic fibers, ceramic fibers, graphite fibers, carbon particles and active or catalytic metal particles.

20. A device according to claim 1 wherein said heat resistant, absorbent material comprises a mixture of wood or paper fibers together with at least one additive selected from the group consisting of (1) inert, fire-resistant additives and (2) additives capable of absorbing or reacting with the polluting emissions from the gases of combustion of the heater.

21. A device according to claim 1 wherein said vertical shaft extends upwardly from said base means, said spinner means and said at least one heat-resistant absorber means both being rigidly mounted on said vertical shaft, and said vertical shaft being rotatable about its axis relative to said base means.

* * * * *